United States Patent [19]

Leneveu

[11] Patent Number: 4,880,239

[45] Date of Patent: Nov. 14, 1989

[54] GOLF TRAINING APPARATUS

[76] Inventor: Michel R. Leneveu, 20 avenue de la République, Presles, France

[21] Appl. No.: 101,180

[22] PCT Filed: Jan. 6, 1987

[86] PCT No.: PCT/FR87/00003

§ 371 Date: Aug. 31, 1987

§ 102(e) Date: Aug. 31, 1987

[87] PCT Pub. No.: WO87/04082

PCT Pub. Date: Jul. 16, 1987

[30] Foreign Application Priority Data

Jan. 6, 1986 [FR] France ..... 86 00150

[51] Int. Cl.[4] ..... A63B 69/36

[52] U.S. Cl. ..... 273/181 F; 273/181 J; 273/184 R; 273/185 R; 73/13

[58] Field of Search ..... 273/181 R, 181 A, 181 B, 273/181 C, 181 D, 181 E, 181 F, 181 G, 181 H, 181 I, 181 J, 181 K, 182 R, 182 A, 184 R, 184 A, 184 B, 185 R, 185 A, 185 B, 185 C, 185 D; 73/13, 379, 380, 381

[56] References Cited

U.S. PATENT DOCUMENTS

| | | | |
|---|---|---|---|
| 1,309,105 | 7/1919 | Sanford | 273/184 R X |
| 1,443,412 | 1/1923 | Hutton | 273/181 J |
| 2,234,814 | 3/1941 | Weaver | 273/181 J |
| 3,411,788 | 11/1968 | Blanding | 273/184 R X |
| 4,511,146 | 4/1985 | Windall | 273/185 R X |

FOREIGN PATENT DOCUMENTS 1122275 7/1955 France .

*Primary Examiner*—Robert E. Garrett
*Assistant Examiner*—Mark A. Williamson
*Attorney, Agent, or Firm*—Charles E. Baxley

[57] ABSTRACT

A sport training apparatus for ball hitting games, such as golf, is provided with a frame which includes a base as well as a pair of uprights. A net is stretched across the uprights and has a pair of lower net corners which each are connected to a weight organized to ride along a rope inclined about 45° from horizontal and spanning between the base and one of the uprights at a higher point. Displacement of the weights measures impact of the ball into the net. Each of the weights is connected by means of a cord to a marker movable on a rod fixed on a graduated ruler to provide a measure of the distance the ball would have traveled unimpededly. A differential between movements of the marks measures direction of the ball.

18 Claims, 5 Drawing Sheets

GOLF TRAINING APPARATUS

The invention relates to an apparatus for training in sports, particularly golf. For training in this sport, in which a ball has to be struck by a club manipulated by the player, various types of simulators are known which, without the ball having to travel its full trajectory, indicate the characteristics of what the trajectory would have been in accordance with the parameters recorded in the striking area (essentially distance and angle of dispersion), these simulators in the present state of the art often being electric or electronic devices.

The invention relates to a new type of training equipment serving the abovedescribed purpose, which comprises a net (or cloth) which is suspended and stretched in such a manner that it absorbs the greater part of the kinetic energy of the ball striking against it and acts to provide appropriate data. This apparatus has an important advantage over known devices in that it comprises only fully reliable, sturdy mechanical equipment insensitive to weather and enabling the simulator to be used outdoors without special precautions.

The apparatus according to the invention comprises a net or cloth suspended vertically at the top and having its two bottom ends fixed to two calibrated weights whose displacement in an inclined plane varies in dependence on the force of the impact of a golf ball on said net.

Figure 1:
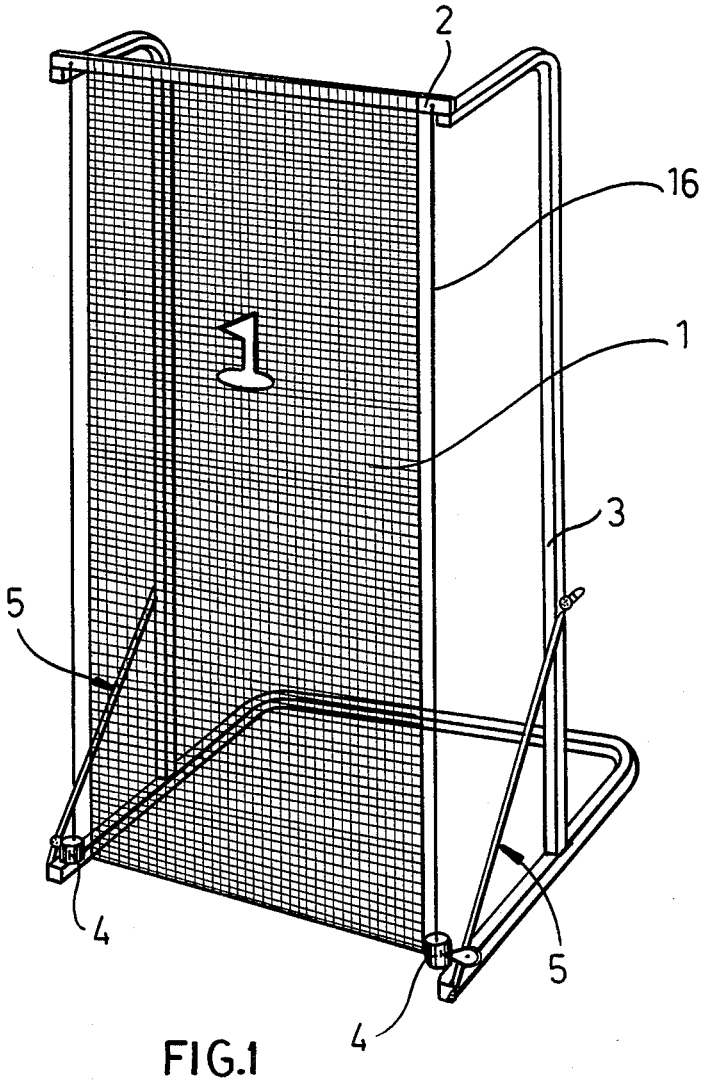
FIG. 1 is a general view of the apparatus.

FIG. 1 shows a cloth 1 stretched vertically. This cloth is composed of a wear resistant woven fabric or net, or of a plastics or similar material, on which golf scenery or any other marking permitting aiming may be depicted. The cloth is fastened at the top to a cross member 2, which in turn is fixed on the two uprights 3 of the simulator frame, which ensures the stability of the whole arrangement. The right-angled bends at the top of the uprights 3 hold the cloth 1 away from said uprights. The bottom corners of the cloth are fixed on two identical calibrated weights 4 which are free to move on the inclined plane formed by two ropes 5 stretched between fixed points on the frame and forming an angle of 45°, which is the ideal ballistic angle for obtaining the optimum trajectory.

The kinetic energy to be absorbed is considerable if it is considered that a golf ball, which weighs about 46 grams, may arrive at a speed of 220 kilometers per hour, and the beginning of the description given above makes it possible to explain one of the characteristics of the invention. When the golf ball arrives on the net 1, the latter is deformed and raised, the bottom corners of the net moving along the inclined plane formed by the ropes 5 through the action of the weights 4 to which they are fixed and which they displace. It is then sufficient to measure the displacement of the weights to obtain information permitting determination of the trajectory which the ball would have followed if it had not struck the net.

Figure 2:
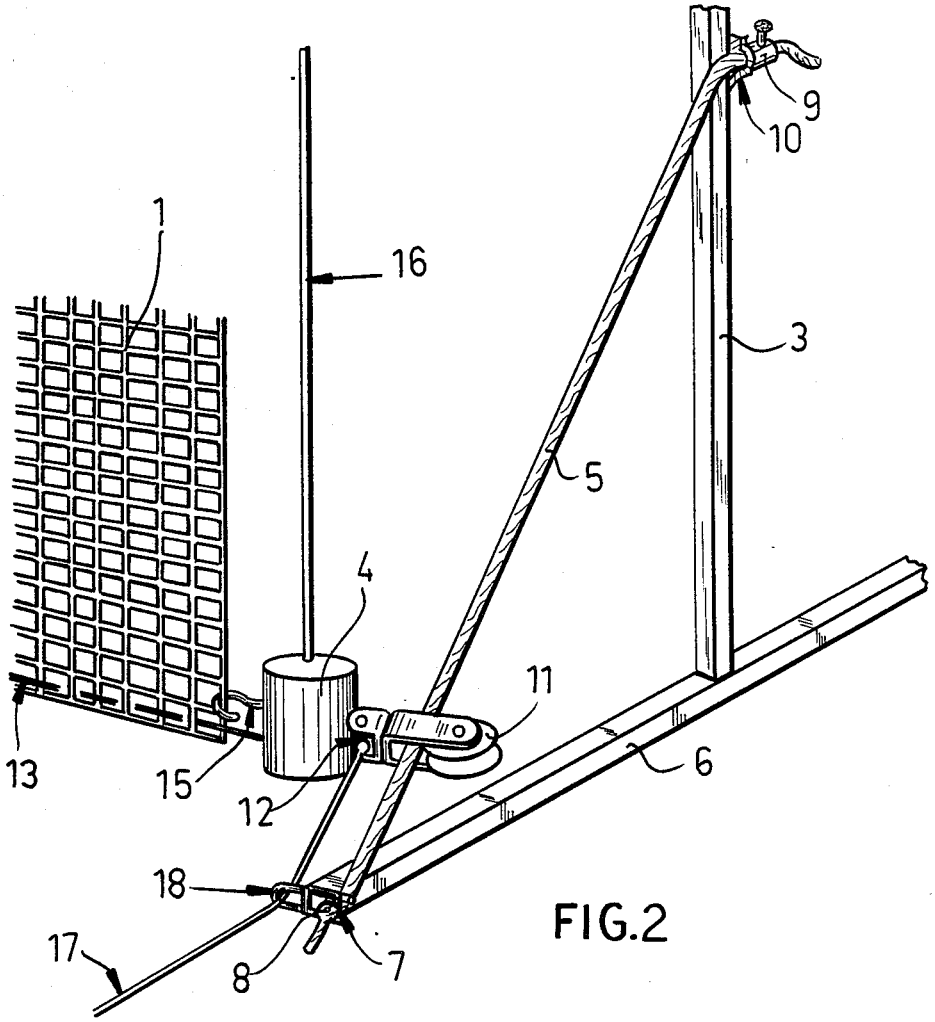
FIG. 2 shows a device for the displacement of the weights on inclined planes.

FIG. 2 shows a device enabling the calibrated weights 4 to move on the ropes 5 without slipping or braking detrimental to good operation. The rope 5 is stretched between a point on the upright 3 and a point on the base 6. On the latter a two-pronged fork 7 holds the end of the rope captive by means of the knot 8. At the other end a ring 9 provided with a stop screw enables the rope to be tensioned, the ring bearing against the two-pronged fork 10 fixed on the upright 3. A pulley 11 identical to those used in boat rigging runs on the rope. The swivel 12 of the pulley is fixed on the weight 4. The latter is provided with a hook 15 enabling it to be fastened to the corner of the net 1.

Figure 3:
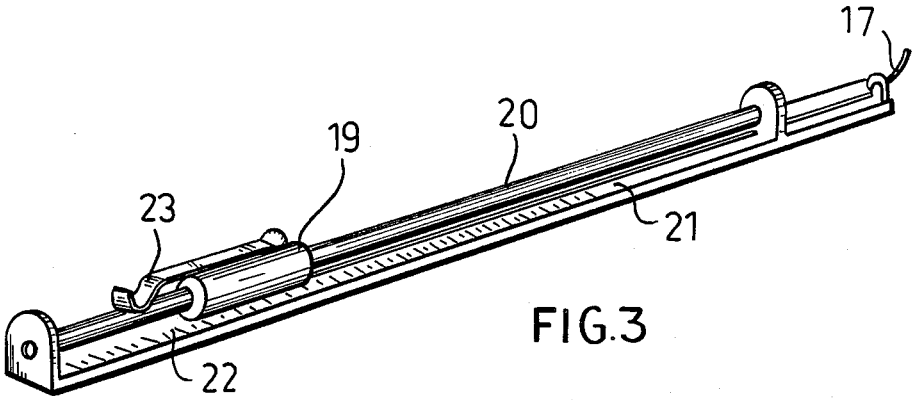
FIGS. 3 and 7 show two systems for evaluation of the results.

In order to ensure that the distance between the weights will not be dependent on the elasticity of the net, the weights may be connected by a rope or cable 13. A rope 16 attached to the top cross member 2 supports the weight 4, so that the net does not permanently support it. In order to evaluate the displacement of the weights on the inclined planes, a cord 17 is fixed to the weight 4, passing through the eye 18 and extending towards two graduated rules, as shown in Figure 3. The cord 17 is connected to a marker 19 which is free to move on a rod 20. The latter is fastened to an elongated U-shaped frame 21 provided with a rule 22, which is graduated after calibration and in front of which the marker moves. A spring 23 pressing against the rod 20 provides a slight, equitable braking action to ensure that the marker will not continue its travel because of inertia after the weights 4 have halted. The marker therefore stops immediately in front of a graduation which can easily be read by the golfer and which because of the calibration corresponds to the distance that the ball would actually have traveled.

Figure 4:
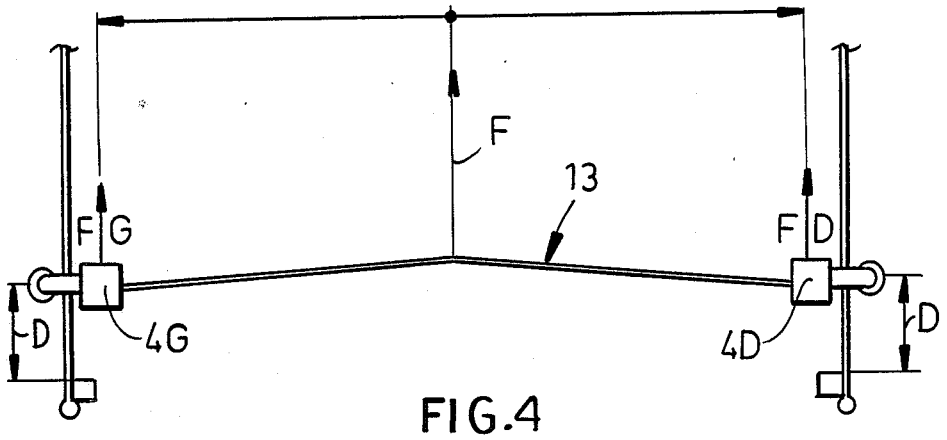
FIGS. 4, 5 and 6 show the graphic determination of the components on impact of the balls on the net of the apparatus.
Figure 5:
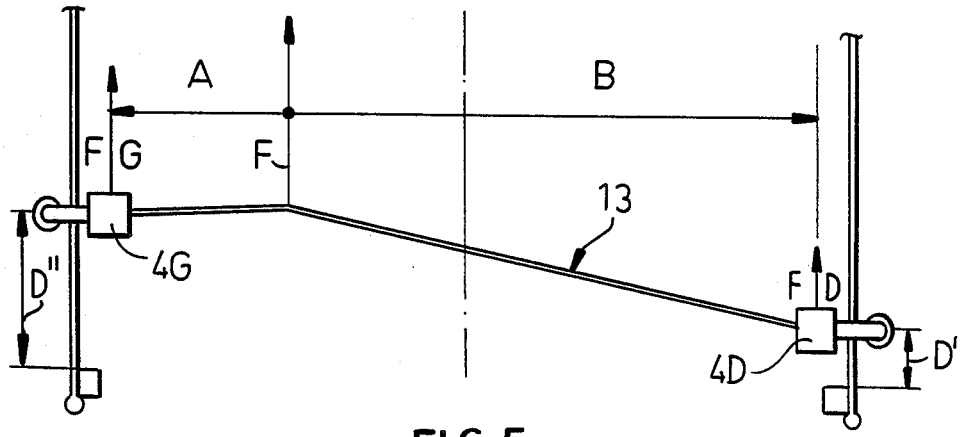
Figure 6:
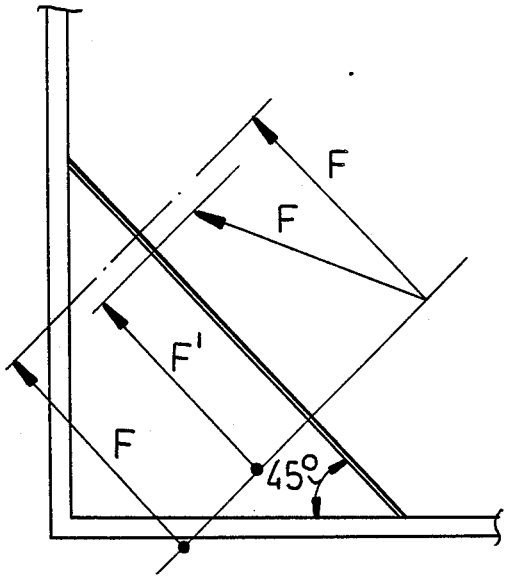

FIGS. 4, 5 and 6 show the graphic determination of the forces and displacements resulting from the impact of the ball on the net, with their incidences on the receiver and evaluation mechanisms. Since in mechanics the displacement of a mass on an inclined plane is proportional to the force applied, the displacement of the weights 4 is also proportional to the force of the impact of the ball on the net 1.

FIG. 4 is a top plan view illustrating how the displacements D of the masses 4G and 4D are identical when the impact is perfectly centered (the forces FD and FG being equal).

FIG. 5 illustrates an example in which the impact of the ball is on the left side of the net. As in mechanics it is demonstrated that $F \times (A - B) = (FD \times B) + (FG \times A)$ and that $FD \times B = FG \times A$, this means that the displacements D′ and D″ of the masses 4G and 4D are different, D″ being greater than D′ in the case of this example. If the respective displacements are evaluated, it is therefore possible to determine with a certain degree of accuracy the lateral distance between the target and the supposed point of impact, this evaluation being obtained direct from the reading on the graduations of the rules at the points where the markers come to rest. However, in order to obtain comparable results, it is important that the player should always play at the same distance from the net. With regard to the distance which the ball would have traveled in the case of a badly centered trajectory, it is sufficient to take the mean of the left-hand and right-hand readings to obtain a satisfactory result.

Figure 7:
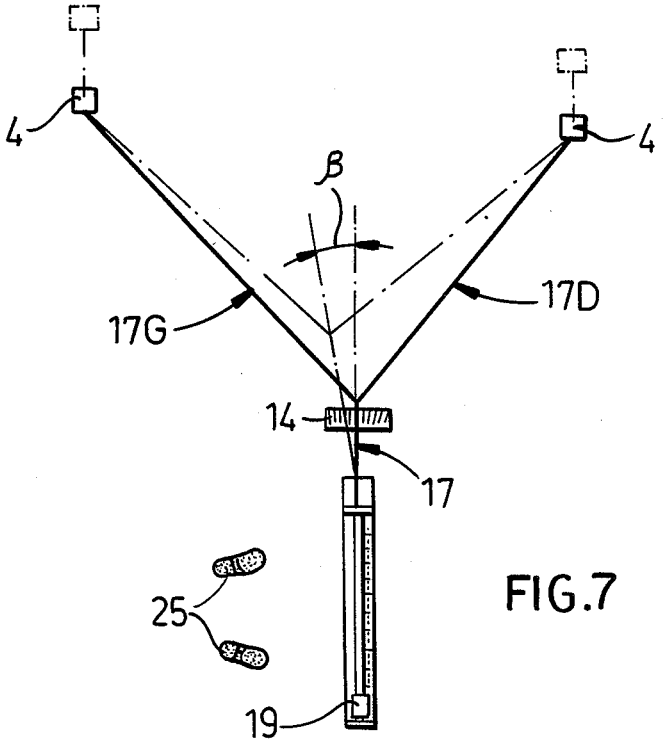

FIG. 7 illustrates another solution to the problem of evaluating results. There is here only one rule, which is identical to those shown in FIG. 3. The two cords 17G and 17D fastened at one end to the weights 4G and 4D are connected at the other end to the cord 17, which moves the marker 19 under the same conditions as those defined above. The mean between the reciprocal displacements of the weights 4G and 4D is obtained automatically, and direct reading of the result is achieved. If one of the weights has a displacement greater than the other (in the case of a badly centered shot), the angular dispersion $\beta$ can be read in clear in dependence on the position of the cord 17 on the graduated, calibrated vector 14 (in dot-dash lines in FIG. 7). The rule must be disposed at the correct distance and so positioned in relation to the apparatus that the cord 17 will be the breakless bisector of the angle formed by the cords 17G and 17D. All this can easily be done on the site by accurate determination of the lengths of the different vectors. The footprints 25 define the position of the player in relation to all the components.

FIG. 6 is a side view showing that, since the ideal trajectory is that defined by a 45° inclined plane, any trajectory different from that angle will generate a different resultant force, F′ being smaller than F; this corresponds to the actual situation on the ground.

It is obvious that the deformations of the net which, as has been shown, derive directly from the characteristics of the trajectory, can be indicated and recorded by an electric or electronic device making it possible to display in clear (for example by liquid crystals) the precise results of the shot concerned.

Figure 8:
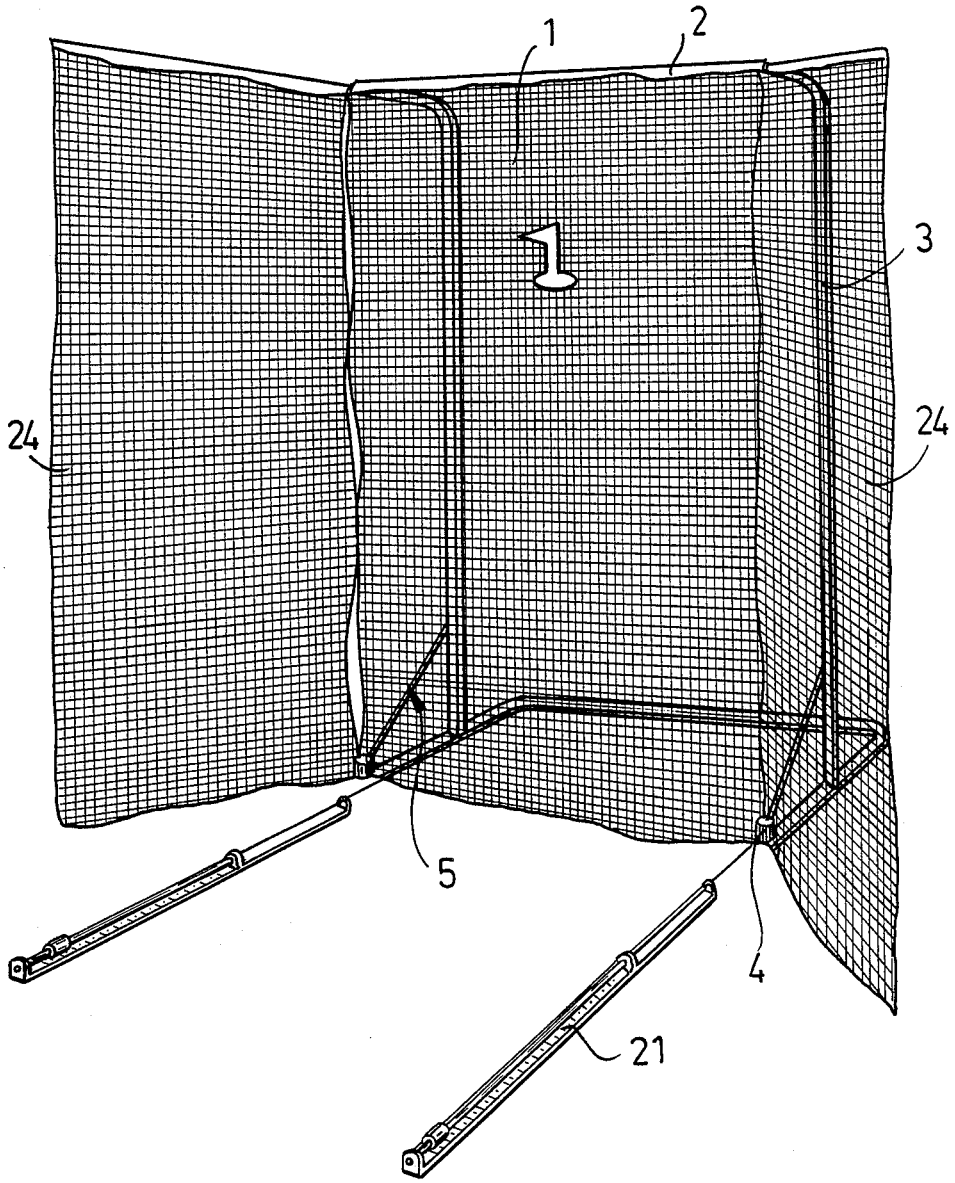
FIG. 8 is a general view including protective nets.

FIG. 8 is a general view showing the addition of two side nets 24 forming a cage for the sake of greater safety; it should be noted that these two nets could be integral parts of the main net 1.

It is clear that this golf training apparatus has been described and illustrated solely by way of explanation without constituting a limitation, and that various modifications could be made to the embodiment indicated without thereby departing from the scope of the invention.

I claim:

1. A sports training apparatus for ball hitting games, particularly golf, comprising, on a stable frame, a cloth (1) suspended on a crossmember (2) forming part of said frame, the two bottom corners of said cloth being fixed respectively to two members (4, 11) which form rings and each of which is free to slide on a rope (5) stretched on each side of the frame between a base and a higher point of said frame, in such a manner that the cloth, which is deformed and raised by the impact of the ball, absorbs the kinetic energy of the latter.

2. The apparatus as claimed in claim 1, wherein each of the parts forming rings incorporates a weight (4) and wherein each of the ropes (5) is stretched along an inclined plane, the displacement of the weights (4) being directly proportional to the impact force, which can thus be evaluated and read in clear.

3. The apparatus as claimed in claim 2, wherein the bottom corners of the cloth are fixed to the two identically calibrated weights (4), on which with the aid of swivels (12) two pulleys (11) are disposed, in such a manner that said weights, which are connected together by a rope (13), are freely displaced on two 45° inclined planes formed by the two ropes (5) held tensioned between a fixed point on an upright (3) of the frame and a fixed point on the base (6) of the frame.

4. The apparatus as claimed in either of claims 2 or 3, wherein the displacement of the weights (4) through the action of the deformation of the cloth as the result of the impact of the ball is proportional to the force resulting from the striking of the ball against the cloth, in such a manner that if the respective displacement of the weights (4) is evaluated or measured the characteristics of the trajectory which the ball would have followed if it had not been stopped by said cloth are obtained after calibration.

5. The apparatus as claimed in claim 4, wherein the weights (4) are connected by means of cords (17) to markers (19) moving on rods (20) fixed on frames (21), each of which incorporates a graduated rule (22), in such a manner that the displacement of the weights entails the displacement of the markers (19) which, because of springs (23), is not affected by inertia, said markers being halted at a graduation corresponding to the result and easily red in clear.

6. The apparatus as claimed in claim 5, wherein the reading of the results on the left-hand and right-hand graduated, calibrated rules (22) makes it possible to evaluate the distance which would really have been traveled by the ball, in such a manner that by taking the mean of the two results the user can, even in the case of a badly centered shot, easily read the length of the trajectory which the ball would actually have followed if it had not been stopped.

7. The apparatus as claimed in claim 6, wherein the reading of the results on the left-hand and right-hand rules (22) makes it possible, in dependence on the respective measurable displacements of the corresponding weights (4) and therefore of the markers (19), to evaluate the lateral distance between the target and the assumed point of fall, in such a manner that if the player always makes his shots at the same distance from the cloth he will be able to read this lateral distance quickly, the displacements of the weights being identical if the impact is perfectly centered.

8. The apparatus as claimed in claim 3, wherein the weights (4) are connected by means of cords (17D) and (17G) to a single cord (17), which is displaced and drives the marker (19) of a single rule composed of a frame (21) provided with a rule (22), graduated after calibration, in front of which said marker (19) moves on a rod (20), a spring (23) pressing against the rod (20) and braking said marker, said rule being suitably positioned in relation to the cloth in such a manner that, since the mean of the reciprocal displacements is thus obtained automatically, the distance which the ball would actually have traveled can be read in clear and the angular dispersion ($\beta$) can be evaluated in dependence on the position of the cord (17) on the vector (14).

9. The apparatus as claimed in claim 7, wherein the deformations of the cloth which derive directly from the characteristics of the trajectory can be indicated and recorded by an electric or electronic device in such a manner that the results can be displayed in clear, for example with the aid of liquid crystals.

10. The apparatus as claimed in claim 1, wherein two side nets (24) can be fixed one on each side of the main frame and thus form a sort of cage, in such a manner that the ball can be driven in full safety in respect of impact on hard parts and in respect of dispersion of the balls in the environment, while these two nets may be integral parts of the main net (1).

11. A sports training apparatus for ball hitting games and comprising:

a frame which includes a base as well as at least one upright, a net depending from the upright and having at least one lower net corner, the lower net corner connected to a weight organized to ride along an inclined member spanning between the base and a higher point on the upright, whereby displacement of the weight measures impact of the ball into the net.

12. A sports training apparatus for ball hitting games and comprising:

a frame which includes a base as well as a pair of uprights, a net depending from the uprights and having a pair of lower net corners, each of the lower net corners connected to a weight which is organized to ride along an inclined member spanning between the base and a higher point on one of the uprights, whereby displacement of the weights measures impact of the ball into the net.

13. The apparatus of claim 12 wherein the weights are equal and both of the members are part of a continuous rope.

14. The apparatus of claim 13 wherein the incline of each of the members is 45° from horizontal.

15. The apparatus of claim 14 wherein each of the weights is provided with a pulley which rides along its related member.

16. The apparatus of claim 15 wherein each of the lower net corners is connected to its related weight by means of a swivel.

17. The apparatus of claim 16 wherein each of the weights is connected by means of a cord to a marker movable on a rod fixed on a graduated ruler, whereby the end position of the marker measures distance the ball would have traveled unimpededly.

18. The apparatus of claim 17 wherein a differential between movements of the respective markers measures direction of the ball.

* * * * *